United States Patent [19]

Holladay

[11] Patent Number: 5,001,898

[45] Date of Patent: Mar. 26, 1991

[54] FUEL DISTRIBUTOR/FLAMEHOLDER FOR A DUCT BURNER

[75] Inventor: Thomas E. Holladay, Lake Park, Fla.

[73] Assignee: United Technologies Corporation, Hartford, Conn.

[21] Appl. No.: 902,358

[22] Filed: Aug. 29, 1986

[51] Int. Cl.[5] ..... F02G 1/00

[52] U.S. Cl. ..... 60/261; 60/749

[58] Field of Search ..... 60/261, 749, 241, 262

[56] References Cited

U.S. PATENT DOCUMENTS

| | | | |
|---|---|---|---|
| 2,942,414 | 6/1960 | Wise | 60/261 |
| 2,944,388 | 7/1960 | Bayer | 60/261 |
| 3,595,024 | 7/1971 | Friedrichshafen | 60/261 |
| 3,698,186 | 10/1972 | Beane et al. | 60/261 |
| 3,750,402 | 8/1973 | Vdoviak et al. | 60/261 |
| 4,312,185 | 1/1982 | Nash et al. | 60/261 |

FOREIGN PATENT DOCUMENTS

| | | | |
|---|---|---|---|
| 650608 | 2/1951 | United Kingdom | 60/749 |

*Primary Examiner*—Louis J. Casaregola
*Assistant Examiner*—T. S. Thorpe
*Attorney, Agent, or Firm*—Troxell K. Snyder

[57] ABSTRACT

A combined fuel distribution and flameholding system (14) includes an improved spraybar (16) having a tapered portion (28) and a radially inwardly disposed tip portion (30). The tapered portion (28) is configured to provide a flow profile (26) diminishing with respect to inward radial displacement from the burner wall (32) for achieving a uniform blockage to free flow area ratio within the burner. The tip portion (30) creates a turbulent or pilot region (32) in the center of the burner, providing a local environment well suited for ignition and low load burner operation. The individual bars (16) are releasable (46) from the exterior of the burner for allowing longitudinal withdrawal of the entire spraybar (16) through a corresponding opening (48) in the burner wall (22).

3 Claims, 2 Drawing Sheets

FUEL DISTRIBUTOR/FLAMEHOLDER FOR A DUCT BURNER

FIELD OF THE INVENTION

The present invention relates to a fuel distributing and flameholding apparatus for use in a gas stream flowing through a cylindrical conduit or the like.

BACKGROUND

Duct burners for elevating the temperature of a stream of gas flowing through a conduit or the like operate by injecting and combusting fuel directly within the gas stream, with the combustion products comingling with the gas downstream of the burner. Where the gas stream being heated contains sufficient oxidant, the fuel is simply mixed with a portion of the flowing gas and the mixture ignited downstream of the fuel distribution system.

In order to operate both efficiently and reliably, the fuel distribution system of a duct burner must achieve the proper fuel-oxidant ratio, at least locally, over the entire burner operating range. It is also desirable to minimize the pressure drop and disruption of the gas stream passing through the duct burner arrangement in order to avoid flow losses and other inefficiencies which may result therefrom.

Prior art duct burning systems are typically designed to match the particular operating parameters of an individual application, for example temperature, gas flow velocity, fuel type, load range, etc. One particularly demanding application is in the use of a duct burner as a part of a thrust augmentor for a high performance aviation gas turbine engine. Such use, common in military and supersonic aircraft, requires a dependable, easily serviceable arrangement which is able to function with relatively high temperature gas streams and over a turndown ratio of up to 10:1 or greater.

One such prior art system, disclosed in U.S. Pat. No. 3,698,186 issued Oct. 17, 1972 to Beane et al shows a plurality of radial fuel spraybars distributed over the gas flow area of a duct burner or thrust augmentor for a gas turbine engine. The individual spraybars are divided into multiple segments corresponding to coaxial fuel distribution zones within the burner. Beane also discloses providing spraybars of differing length in an individual duct burner, resulting in a greater number of spraybar structures disposed in the outermost coaxial gas flow zone and progressively fewer spraybars in the intermediate and innermost zones.

Such prior art fuel distribution systems as are shown in Beane have a number of drawbacks which tend to reduce their efficiency and operability, particularly in high temperature, high performance thrust augmentor configurations. The use of differing length spraybars in an individual duct burner creates a non-uniform, discontinuous flow blockage distribution with respect to radial displacement, forcing a portion of the gas flowing adjacent the conduit or augmentor walls to flow radially inward in response to the greater fraction of the flow area obstructed by the spraybars. Such radial flow results in a nonuniformity of the radial velocity distribution downstream of the duct burner, reducing augmentor efficiency and thrust output.

Additionally, the termination of the shorter individual spraybars at differing radial displacements within the gas flow area initiates turbulent disruptions in the gas flow at the tip of each spraybar. Such disruptions, including for example trailing vortices extending downstream of the terminating tip of a shortened spraybar, disrupt the carefully optimized fuel-gas mixture created downstream of the fuel distribution system by the aerodynamically configured spraybars. For certain high temperature applications wherein the fuel gas mixture is close to its self-ignition temperature, the presence of even small flow disruptions caused by a terminating spraybar within the flowing gas stream can result in premature ignition of the fuel-gas mixture and thereby damage augmentor structures such as the fuel distributor, flameholder, etc.

What is needed is a fuel distribution and flameholding arrangement which avoids inducing radial flow within the gas stream, avoids inducing undesirable turbulence within the gas stream, and which provides the desired fuel-gas mixture ratio over a wide range of burner fuel and gas mass flow rates.

SUMMARY OF THE INVENTION

It is therefore an object of the present invention to provide a fuel distribution system for a duct burner which maintains a uniform gas mass flux density over the entire gas flow area.

It is further an object of the present invention to provide a localized turbulent gas flow region for establishing and maintaining a pilot combustion reaction.

It is further an object of the present invention to maintain an undisturbed gas flow in the duct upstream of the duct burner flameholder exit plane for avoiding premature ignition of the fuel-gas mixture.

It is further an object of the present invention to provide a distribution system with internally disposed components fully accessible from the exterior of the duct burner.

It is still further an object of the present invention to provide a fuel distribution system wherein the pilot combustion reaction is optimally positioned for igniting the adjacent combustion regions and thereby enhancing the stability of the total combustion reaction.

According to the present invention, a plurality of fuel spraybars are disposed in the flowing gas stream in a substantially transverse orientation. The spraybars are oriented radially and distributed about the circumference of the round duct burner, further including internal fuel conduits for conducting the burner fuel from one or more external supply manifolds to discharge openings distributed along the length of each spraybar.

Each spraybar is divided into two portions, a tapered portion spanning the annular flow area immediately within the burner wall, and a tip portion disposed in the center pilot region coaxially within the annular flow area. The tapered portion of each spraybar presents a flow profile, when viewed in the gas flow direction, which diminishes directly with inward radial displacement from the duct burner wall. The proportion of open to blocked flow area at any given radius within the annular flow area is thus constant and results in a uniform gas mass flux density across the duct burner.

The tip portion of each spraybar flares transversely outward, providing a local zone of increased gas turbulence. The turbulent zone forms a pilot region wherein initial burner lightoff and low load combustion occurs. The high local turbulence promotes hot gas recirculation necessary to stabilize the combustion reaction at such lower fuel flow rates, but is confined in the present invention to a relatively small portion of the total gas flow stream, thereby avoiding an undesirably high overall burner pressure drop.

By sizing the tip portion no greater than the radially outer end of the tapered portion, each spraybar of the fuel distribution system according to the present invention is individually withdrawable longitudinally through the duct burner wall for repair or replacement. Still another advantage of the fuel distributor according to the present invention is the realization of enhanced flame propagation from the pilot region into the surrounding annular gas flow, particularly when the spraybar structure functions as a combined spraybar-flameholder. By inclining the spraybars upstream into the flowing gas, the pilot region combustion reaction is well positioned to ignite and stabilize combustion in the surrounding annular area.

The fuel distribution system according to the present invention thus provides a spraybar configuration and arrangement which is simpler in design, more effective in operation, and easier to repair than prior art systems. The individual spraybars within the system are identical, and thus interchangeable, reducing the required inventory of spare parts. Both these and other advantages will be apparent following a careful review of the following description and the appended claims and drawing figures.

BEST MODE FOR CARRYING OUT THE INVENTION

Figure 1:
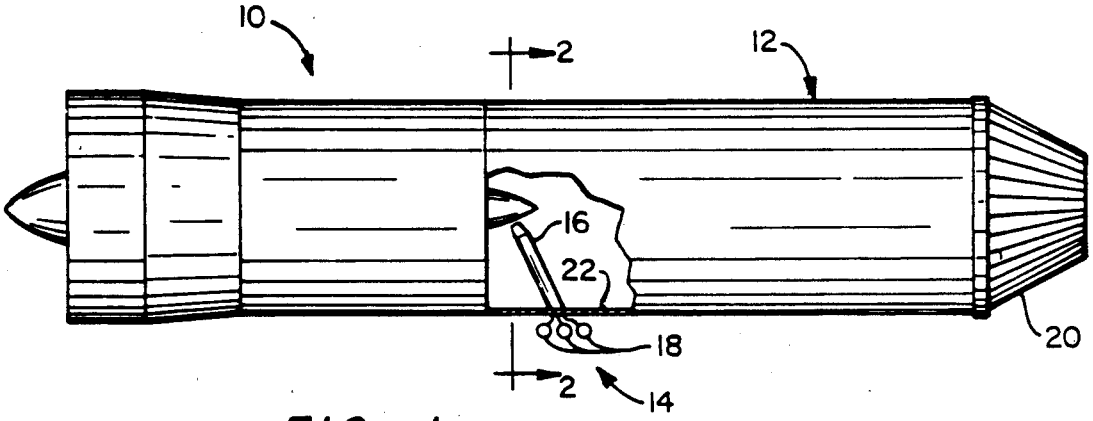
FIG. 1 shows a side view of a gas turbine engine and associated augmentor, with a portion cut away to illustrate the fuel distribution system according to the present invention.

Referring now to the drawing Figures, and in particular to FIG. 1 thereof, a gas turbine engine 10 is shown having a thrust augmentor, or duct burner, 12 secured to the outlet thereof. The augmentor includes a fuel distribution means 14 having a plurality of individual spraybars 16 for receiving and distributing liquid fuel supplied by one or more fuel supply conduits 18. The engine exhaust gases, heated by the combustion reaction occuring downstream of the fuel distribution assembly 14 are exhausted through a variable flow area nozzle 20 shown at the downstream end of the augmentor 12.

Figure 2:
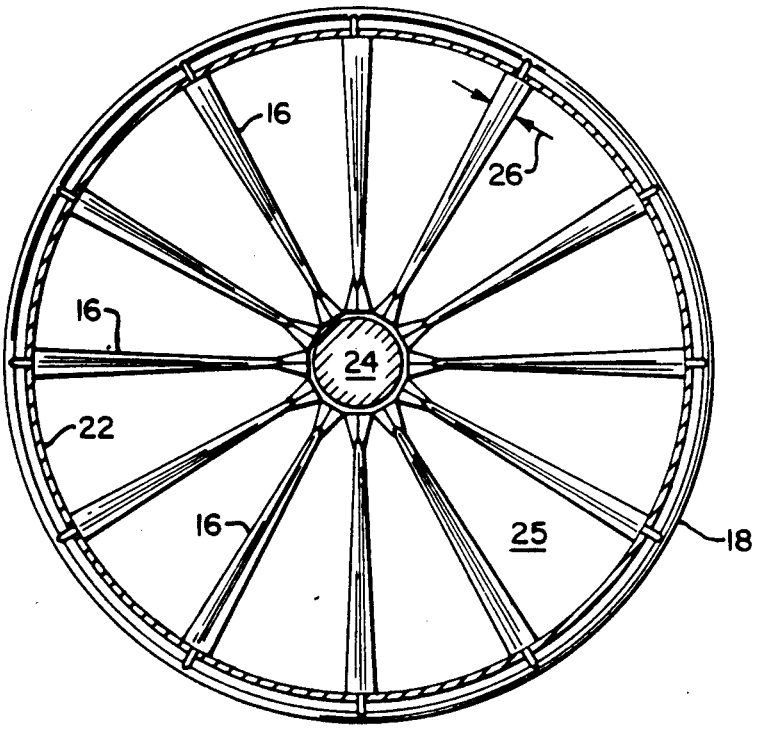
FIG. 2 is an axial view of the fuel distribution/-flameholding system as indicated in FIG. 1.

FIG. 2 is an axial view of the duct burner as indicated in FIG. 1, showing a plurality of radially oriented spraybars 16 extending inward from the augmentor wall 22 across the circular gas flow area 25. The individual spraybars 16 may be cantilevered from the augmentor wall 22 or may additionally be supported at the radially inner ends thereof by engagement with the engine tail cone 24 or other similar supporting structure. It should be noted that the individual spraybars are evenly distributed about the circumference of the augmentor 22 and each extend from the wall 22 into the gas flow area 25 an equivalent radial distance.

Figure 3:
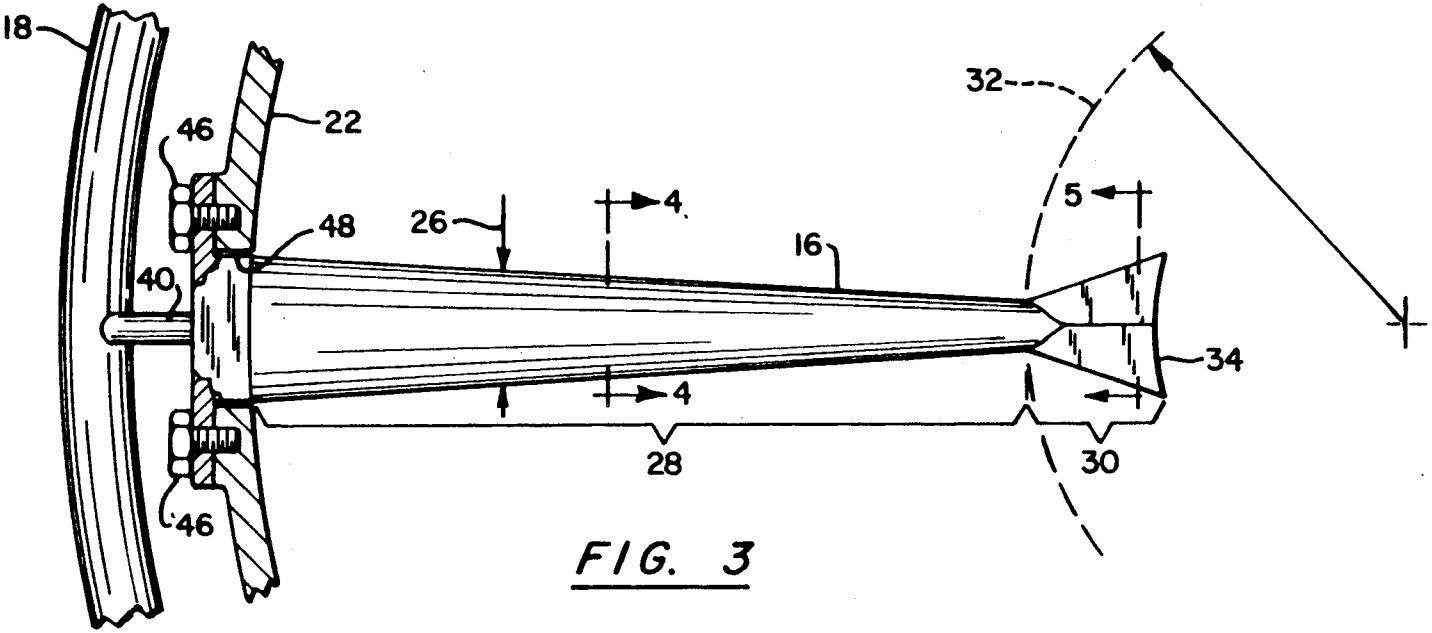
FIG. 3 is an axial view of a single spraybar element according to the present invention.

FIG. 3 shows a detailed view of an individual spraybar 16 according to the present invention. The elongated spraybar 16 is divided into two portions along the length thereof, a tapered portion 28 and a tip portion 30. The tapered portion 28 comprises that portion of the spraybar 16 extending radially inward from the augmentor wall 22 until intersecting the shorter tip portion 30. The tapered portion 28 of the spraybar 16 presents a flow profile 26 which diminishes in proportion to the radial displacement from the augmentor wall 22.

The tip portion 30 flares transversely in a relatively abrupt fashion as compared to the tapered portion 28, forming a coaxially central pilot region 32 wherein high local gas turbulence and recirculation is present. Such turbulence is due both to the sharp discontinuity of blocked to free gas flow area ratio caused by the flared tip 30, as well as a result of the termination of the spraybar 16 which causes the formation of trailing vortices (not shown) from at least the radially inner end 34 of the spraybar 16.

One feature of the fuel distribution system according to the present invention is the uniformity of flow blockage imposed by the plurality of spraybars 16 over substantially all of the gas flow area 25. The flow profile 26, or transverse thickness, of each spraybar 16 decreases directly in proportion to inward radial displacement from the augmentor wall. This configuration results in an equivalent ratio of blocked to free flow area at any given radius within the gas flow area 25 outside of the pilot region 32.

This uniformity of blocked to free flow area irrespective of radial position within the duct burner avoids inducing radial flow in the engine exhaust gases passing therethrough, thus maintaining a similar distribution of mass flow per unit area (i.e., mass flux density) across the fuel distribution system 14.

Figure 4:
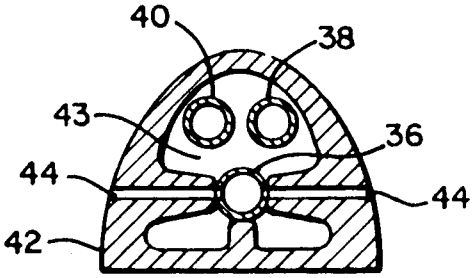
FIG. 4 is a transverse cross section of the spraybar element of FIG. 3 as indicated.

FIG. 4 shows a cross sectional view of the tapered portion 28 of the spraybar 16 as indicated in FIG. 3. The spraybar section in FIG. 4 shows a plurality of fuel conduits 36, 38, 40 disposed within an internal cavity 43 which may additionally carry a flow of cooling air for thermally protecting the body 42 and fuel conduits 38, 40. A first conduit 36 is shown supplying liquid fuel to a pair of transversely oriented discharge openings 44 disposed in the surface of the bluff body 42. The use of multiple fuel conduits 36, 38, 40 is common in thrust augmentor arrangements wherein combustion is staged sequentially over a plurality of coaxial combustion zones. The bluff body 42 is configured so as to present a convex upstream surface to the flowing gas, thus minimizing local flow disruption and turbulent losses in the gas stream, while inducing the necessary gas turbulence downstream to achieve the proper flameholding performance.

Figure 5:
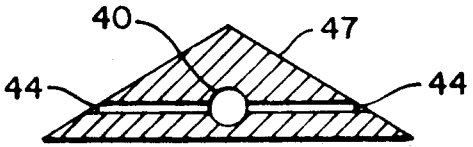
FIG. 5 is a transverse cross section of the tip portion of the spraybar element as indicated in FIG. 3.

FIG. 5 shows a cross section of the tip portion 30 of the spraybar 16 and also shows another bluff body 47 having an internal fuel conduit 40 for supplying fuel to one or more discharge openings 44 disposed in the body surface. The tip portion 30 of the spraybar 16 supplies fuel to the pilot region 32. In the arrangement according to the present invention, the high turbulence pilot region induces gas recirculation and other local flow abnormalities which insure that the fuel-gas mixture within the pilot region 32 is both well mixed and ignited by currently reacting combustion components. The close proximity of adjacent spraybar tips 34 (see FIG. 2) assist circumferential flame propagation between spraybars. It will be appreciated that the initial augmentor lightoff may be accomplished by known ignition methods and apparatus, such as hot streaking and/or electric spark discharge.

The turbulent pilot zone 32 forms a coaxial region within the augmentor 12 wherein flame stability at low fuel flow is enhanced. Such stability enhancement is achieved at the cost of some local pressure drop caused by the vigorous gas mixing and recirculation induced by the flared tip portion 30. It has long been appreciated that such stability over the entire gas flow area 25 may be achieved in a similar fashion, however, the increased gas pressure drop resulting therefrom is both undesirable and unnecessary in the fuel distribution system according to the present invention due to the adjacency of the stable pilot reaction within the turbulent zone 32 and that portion of the engine exhaust flowing over the tapered portions 28 of the spraybars 16.

Reaction stability in the gas flow surrounding the turbulent region 32 is further enhanced by inclining the individual spraybars 16 forward into the flowing gas from the augmentor wall 22 as shown in FIG. 1. The pilot combustion reaction within the turbulent zone 32 is thus not only adjacent but also upstream of the mixed fuel and gas in the surrounding annular flow area.

Still another feature of the spraybars of the fuel distribution system according to the present invention is the enhanced serviceability provided by the integrated distributor-flameholder. As shown in FIG. 3, the entire spraybar 16 may be withdrawn longitudinally from the exterior of the augmentor by removing the securing means, such as the illustrated bolts 46, and slipping the spraybar 16 including the tip portion 30 through a corresponding opening 48 in the augmentor wall 22.

Such removal allows easy replacement and refurbishment of not only the main portion of the fuel distribution means, i.e., the tapered portion 28, but also the pilot fuel distribution structure corresponding to the tip portion 30 of the spraybar 16. The entire augmentor fuel distribution system is thus integrated in the spraybar configuration and arrangement according to the present invention and does not utilize multiple systems and structures as is common in prior art augmentors.

As will also be appreciated by those skilled in the art, the smooth transition of the flow profile 26 of the individual spraybars 16 throughout the tapered portion 28 avoids inducing any local turbulent or vortex flow which may prematurely ignite the fuel-air mixture. In the pilot region 32 such turbulence is actively induced by the flow profile of the tip portion 30 for ensuring ignition over a variety of burner operating conditions. The particular configuration of the spraybar 16 according to the present invention is further well suited for modern high performance gas turbine engine thrust augmentor applications wherein the spraybar 16 functions as a combined fuel distributor-flameholder for initiating and maintaining the onset of the combustion reaction immediately adjacent the downstream edges of the spraybar 16.

As there are numerous other spraybar and fuel distribution system configurations which may be made without departing from the spirit and the scope of the present invention, it should be understood that the descriptions and depictions of the preferred embodiment system and spraybar presented hereinabove and in the appended drawings are to be taken in an illustrative and not a limiting sense.

I claim:

1. An integrated fuel distributor and flameholder for a thrust augmentor receiving a stream of exhaust gas from a gas turbine engine, the augmentor including a cylindrical wall defining a circular gas flow area therewithin, comprising: a plurality of elongated, separate spraybars distributed over the augmentor gas flow area for discharging a flow of fuel into the augmentor gas stream, each spraybar secured to the augmentor wall at one end thereof and extending equally radially inward therefrom, each spraybar further including a tapered portion, extending from adjacent the augmentor wall to a central, coaxial pilot region within the gas flow stream, and having a transverse flow profile presented to the gas stream diminishing proportionally with respect to inward radial displacement from the augmentor wall, means, disposed radially inward of the tapered portion and within the central, coaxial pilot region, for inducing high gas turbulence within the pilot region relative to the surrounding gas flow, said turbulence inducing means including a flared tip portion of the spraybar, the tip portion having an increasing transverse flow profile with respect to increasing inward radial displacement, and a plurality of fuel conduits, running longitudinally with each spraybar between a corresponding plurality of external fuel supply manifolds and corresponding pluralities of fuel discharge openings disposed in each spraybar, at least one conduit and at least one corresponding plurality of discharge openings in each spraybar being exclusively for discharging fuel at the tip portion thereof.

2. The integrated fuel distributor and flameholder as recited in claim 1, wherein each spraybar is inclined upstream from the augmentor wall into the gas stream.

3. A plurality of equal length, radially oriented, transverse spraybars for distributing fuel into a stream of gas flowing in a cylindrical duct burner and stabilizing a resulting combustion reaction, each spraybar comprising:

an elongated tapered portion extending into the gas stream to a central, coaxial pilot region therewithin, the tapered portion having a flow profile diminishing directly with respect to inward radial displacement, a tip portion, disposed radially inward of the tapered portion and within the pilot region, the tip portion having a transversely flared flow profile to induce turbulence in a portion of the gas stream flowing through the pilot region for holding the combustion reaction to the spraybar, and means for selectively and independently discharging fuel into the gas stream from the tip and tapered portions of the spraybar.

* * * * *